United States Patent [19]

Hesener

[11] Patent Number: 5,029,363

[45] Date of Patent: Jul. 9, 1991

[54] PIVOTAL HINGE FOR AN ARM OF AN AWNING

[75] Inventor: Karl Hesener, Finnentrop-Heggen, Fed. Rep. of Germany

[73] Assignee: Paul Voss GmbH & Co., Finnentrop Heggen, Fed. Rep. of Germany

[21] Appl. No.: 509,852

[22] Filed: Apr. 16, 1990

[30] Foreign Application Priority Data

May 19, 1989 [EP] European Pat. Off. ..... 89109016.9

[51] Int. Cl.[5] ..... E05D 7/06; E04F 10/06

[52] U.S. Cl. ..... 16/241; 16/349; 16/353; 160/22

[58] Field of Search ..... 16/349, 241, 353; 160/22

[56] References Cited

U.S. PATENT DOCUMENTS 4,566,516 1/1986 Lohausen ..... 160/22
4,590,642 5/1986 Hesener ..... 16/241

FOREIGN PATENT DOCUMENTS 2752872 5/1979 Fed. Rep. of Germany ..... 160/22

*Primary Examiner*—Robert L. Spruill
*Assistant Examiner*—Carmine Cuda
*Attorney, Agent, or Firm*—Edwin D. Schindler

[57] ABSTRACT

A pivotal hinge for an arm of an awning, comprising a supporting block tightly clampable on a supporting means and a pivotal bracket tiltable into an emergent position about a substantially horizontal axis, on which pivotal bracket an arm is pivotable about an axis oriented transversely to the tilting axis, the pivotal bracket and the supporting block being coupled by a coupling rod with thread and an adjusting nut, allowing and limiting the tilting movement, and a blocking slide being coupled with the arm, which blocking slide is movable transversely to the axis of the coupling rod and locks same in the emergent position. The adjusting nut is formed as a cylinder body having a cylindrical surface with a thread passage in the radial direction. A cylinder segment cup is provided as reception for the cylindrical surface of the adjusting nut. The blocking slide contacts the cylindrical surface of the adjusting nut in the emergent position.

7 Claims, 2 Drawing Sheets

PIVOTAL HINGE FOR AN ARM OF AN AWNING

BACKGROUND OF THE INVENTION

1. Field of the Invention

The invention relates to a pivotal hinge for an arm of an arming, comprising a supporting block tightly clampable on a supporting means and a pivotal bracket tiltable into an emergent position about a substantially horizontal axis, on which pivotal bracket an arm is pivotable about an axis oriented transversely to the tilting axis, the pivotal bracket and the supporting block being coupled by a coupling rod with thread and an adjusting nut, allowing and limiting the tilting movement, and a blocking slide being coupled with the arm, which blocking slide is movable transversely to the axis of the coupling rod and locks same in the emergent position.

2. Description of the Prior Art

A pivotable hinge of said type is known from the DE-PS 32 06 963. Therein the coupling rod has a stop profile, which, on the one hand, limits the tilting motion and which, on the other hand, is engaged by the blocking slide in the blocking position. This requires an extremely complicated and precise treatment and processing of the blocking profile and of the blocking slide, which needs a profiled reception. The stop profile or another adjusting element is embraced by the blocking slide, which is arranged coaxially to same.

SUMMARY OF THE INVENTION

One object of the invention is such a configuration of the pivotable hinge that the function of the stop is independent of the blocking slide and that a blocking slide which can easily be manufactured can be utilized.

According to the invention this object is solved in that the adjusting nut is formed as a cylinder body having a cylindrical surface with a thread passage in the radial direction, that a cylinder segment cup is provided as reception for the cylindrical surface of the adjusting nut, and that the blocking slide contacts the cylindrical surface of the adjusting nut in the emergent position.

The invention differs from the prior art in that the blocking slide is a part having a constant cross-section. In the simpliest case it is a drawn rod or a wire. A mechanical treatment of the blocking slide is not necessary at all in this case. The adjusting nut has a cylinder profile, which, in the emergent position, finds reception in a cylinder segment cup. The rod abuts approximately opposite the cylinder segment cup on the cylindrical surface of the adjusting nut so that the adjusting nut is positively locked between the rod and the cylinder segment cup. A rotation of the adjusting nut when adjusting the incline of the awning is possible without difficulty, however the blocking, i.e. the return kick safety, remaining secured.

The coupling rod is held positively and the rotation thereof is not influenced in that, within the supporting block, a bolt with a transverse passage and with a reception for a ball end of the coupling rod is provided.

The operation of the coupling rod is easily possible, in that an adjusting means is provided in the foot of the coupling rod.

A securing of the set incline is possible in that the adjusting nut comprises a transverse hole for a locking screw.

In order that the coupling rod is guided and supported during the tilting movement and in the upward retracted position, it is provided that the arm comprises a connecting link guide for a coupling pin of the blocking slide.

A straight guidance of the blocking slide is secured in that the arm comprises a connecting link guide for a coupling pin of the blocking slide.

A frictionless guidance is achieved in that the connecting link guide has a keyhole-shaped profile.

BRIEF DESCRIPTION OF THE DRAWINGS

One embodiment of the invention will be described in the following with reference to the drawings, wherein.

DESCRIPTION OF THE PREFERRED EMBODIMENT

Figure 1:
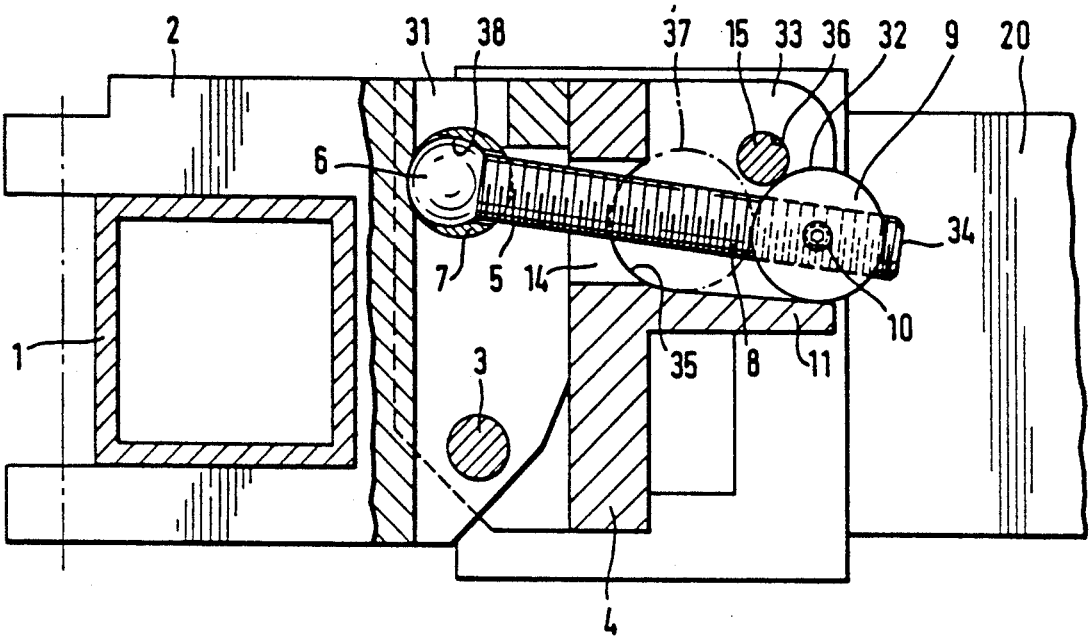
FIG. 1 shows a pivotal hinge in the side view.

FIG. 1 shows a square support tube 1 for an awning. On this square support tube 1 the arm hinges are each arranged, one supporting block 2 each embracing the support tube 1 and being clamped tightly on same. The supporting block 2 may also be fastened to another supporting structure, e.g. a cantilever or a support profile.

The supporting block 2 receives a trunnion 3 arranged substantially horizontally as pivotal axle, on which a pivotal bracket 4 is tiltably arranged. The pivotal bracket 4, in addition, is coupled with the supporting block 2 by a coupling rod 5, which allows the pivotal movement of the pivotal bracket 4 and limits same. The coupling rod 5 is configurated with a round head 6 in a receiver 38 of a bolt 7. The receiver 38 consists of a transverse passage and a ball socket. The bolt 7 is guided in lateral eyes 31 of the support bracket 2.

The coupling rod 5 comprises a thread 8, which engages an internal thread of an adjusting nut 9. The adjusting nut 9 is formed as cylinder body with a cylindrical surface 32 and a thread passage in the radial direction. The adjusting nut 9 is guided between walls 33 of the pivotal bracket 4. In the basis face of the coupling rod 5 an operating device 34 is provided, which, for example, is provided as operating slot and enables a rotation of the coupling rod 5 for a spindlelike displacement within the adjusting nut 9, in order to limit thereby the pivoting movement. Within the adjusting nut 9 a thread hole for locking screw 10 is provided, in order to secure the adjustement of incline.

The pivotal bracket 4 comprises a passage 14, the frontal face of which is provided as cylinder segment socket 35. The diameter of this cylinder segment socket 35 is equal to the outer diameter of the cylindrical surface 32 of the adjusting nut 9 so that the adjusting nut can move in a rolling manner within the cylinder segment socket. In FIG. 1 the cross-section of the cylinder segment socket 35 is extended to a circular line 37. A support leg 11, oriented to the passage 14, is provided, on which support leg the adjusting nut 9 slides and is supported in the retracted position of the awning.

One passage 36 with circular cross-section extends through the walls 33 of the support bracket 4. The cross-section line of the passage 36 touches the circular line 37 determined by the cylinder segment socket 35 and overlapped in the emergent position by the adjusting nut 9. Thereby it is achieved that the cylindrical surface 32 of the adjusting nut 9 and the outer face of the rod 15 contact each other in the locked emergent position.

The pivotal bracket 4 comprises a passage 36 with circular profile, this passage 36 extending through both walls 33 of the pivotal bracket 4. Within the passage 36 a rod 15 is displacable, which rod serves as blocking slide. In the simpliest case the rod 15 is a drawn or a rolled round profile. The rod 15 engages, with a coupling pin 16, a connecting link guide 17 in a projection 18 of a arm 20. The arm 20, via a bearing pin 19, is pivotably positioned in the pivotal bracket 4 so that the arm 20 can be swivelled back between the emergent position as drawn in FIG. 2 in solid lines and the retracted position, drawn by dash-dot lines. The connecting link guide 17 has a keyhole-shaped profile, in order to enable a straight guidance of the rod 15 in the pivoting motion of the arm 20.

Figure 2:
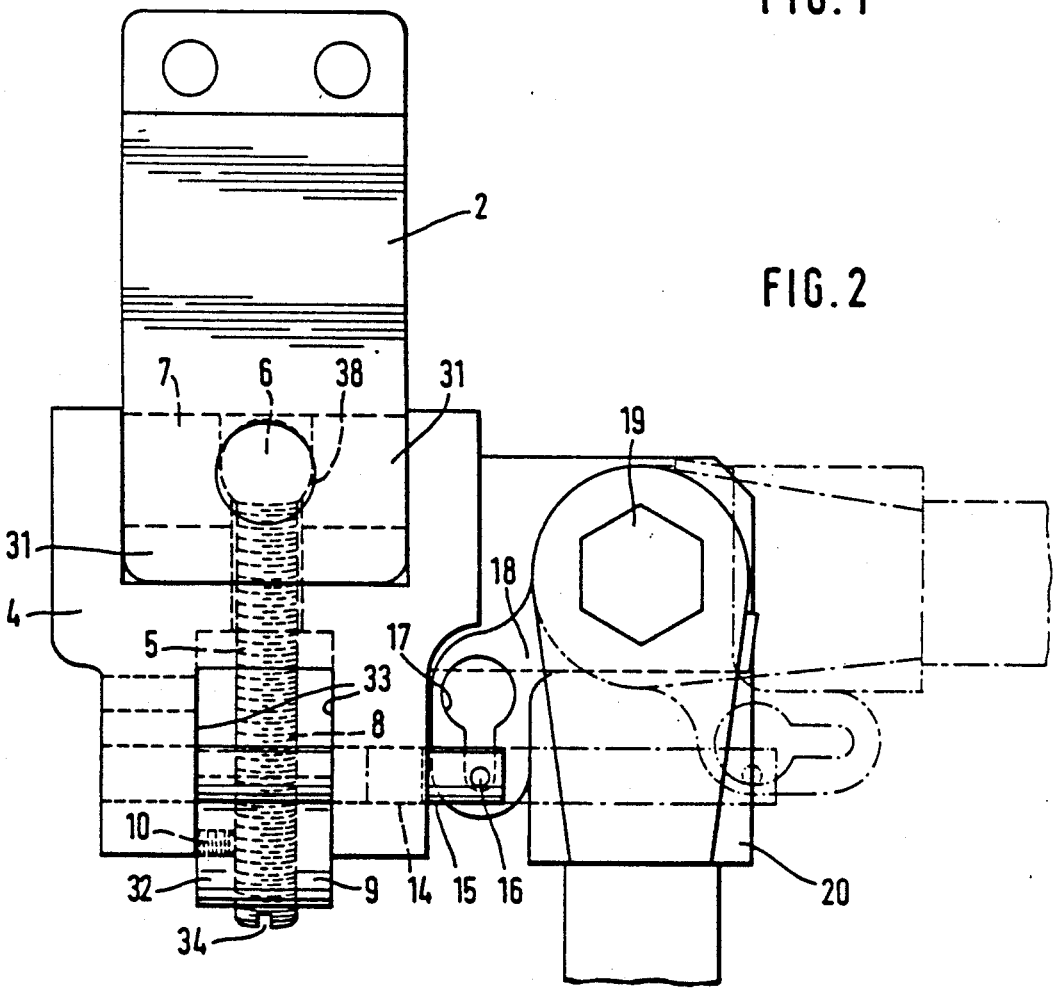
FIG. 2 is a top view in regard to FIG. 1, whilst
Figure 3:
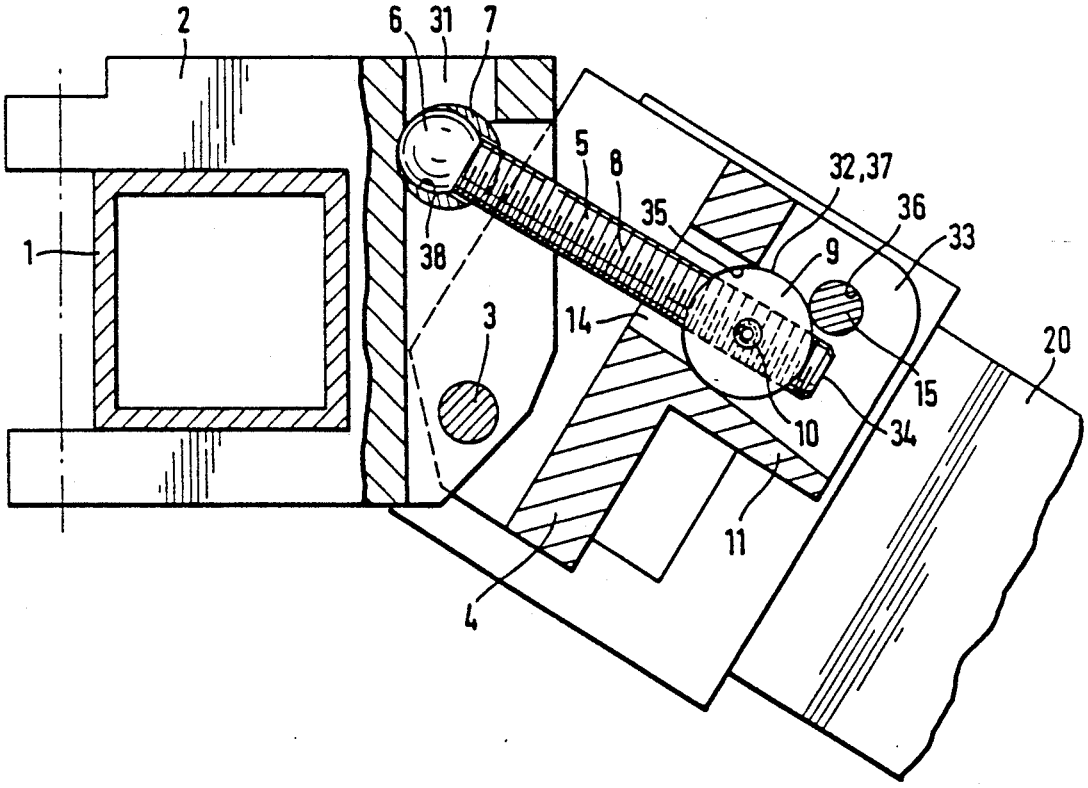
FIG. 3 is a side view of the pivotal hinge in the emergent position.

FIGS. 1 and 2 show the hinge in the retracted position of the arm, the retracted position being drawn in FIG. 2 in dash-dot lines. The rod 15 is retracted far to the right so that same does not project into the cutout between the walls 33 and into the range of the adjusting nut 9. The coupling rod 5 is pivotably held within the bolt 7. The adjusting nut 9 is lifted from the cylinder socket 35 and is situated on the suport leg 11.

If the arm is emerged out by the rotation of the canvas shaft, the pivotal bracket 4 will pivot about the trunnion 3 very rapidly into the emergent position according to FIG. 2. Thereby the adjusting nut 9 engages the cylinder segment socket 35 so that the pivotal movement of the pivotal bracket 4 is limited. The rod 15 is retracted from the range of the adjusting nut 9 so that the movement of the adjusting nut 9 and of the coupling rod 5 is possible without difficulty. As soon as during the further moving out of the canvas the arms 20 swivel into the emergent position, the rod 15, related to FIG. 2, is displaced to the left into the position as drawn by solid lines. The rod 15 thereby moves past the circumferential face of the adjusting nut 9 and also engages the opposite wall 33. The adjusting nut 9, thus, is kept on its circumferential face or cylinder face 32 in such a manner that same can not evade any more. On the one hand, same is situated in the cylinder segment socket 35, and, on the other hand, same is blocked on its rear side by the rod 15. Thereby a secure kick-back locking is guaranteed.

However, the profile faces being in engagement with one another can be treated and processed very easily. The rod engages merely on the adjusting nut 9. An embracing of the coupling rod 5 is not necessary. The adjusting nut 9 as well as the rod 15 comprise merely cylindrical faces, which can be processed without difficulty. The rod 15 itself can be a drawn or rolled profile, particularly a round profile, the outer face of which does not require any processing or treatment.

The adjusting nut is held and secured on its cylindrical surface, on the one hand, by the cylinder segment socket 35 and, on the other hand, by the rod 15, the rod 15 serving as kick-back locking. An embracing and holding of the coupling rod 5 is not necessary.

In case of the adjustement of incline by turning the coupling rod 5 by means of the operating device 34 the adjusting nut 9 can unimpededly rotate within the cylinder segment socket 35, because same can move past the rod 15. Thus, the invention renders possible an easy adjusting of incline in the extended condition. The rod 15 is inevitably moved when moving the arms out and in. The hinge has a large pivotal range. The embodiment as shown enables a swiveling range of approximately 45°. The locking itself is less susceptible to trouble due to the fact that same is effected by a rod. The rod is coupled with a connecting link guide. Also in this case easy accessibility is guaranteed.

Due to its simplified design and construction it is possible to produce the hinge at low costs so that it has large fields of application. It is also possible to equip awnings or sun-blinds without box/case with a pivotal arm hinge. The pivotal arm hinge, as is known, offers the advantage that the awning can be moved close to the holding device in the retracted condition.

I claim the following:

1. A pivotal hinge for an arm of an awning, comprising a supporting block tightly clampable on a supporting means and a pivotal bracket tiltable into an emergent position about a substantially horizontal axis, on which pivotal bracket an arm is pivotable about an axis oriented transversely to the tilting axis, the pivotal bracket and the supporting block being coupled by a coupling rod with thread and an adjusting nut, allowing and limiting the tilting movement, and a blocking slide being coupled with the arm, which blocking slide is movable transversely to the axis of the coupling rod and locks same in the emergent position, characterized in that the adjusting nut is formed as a cylinder body having a cylindrical surface with a thread passage in the radial direction, that a cylinder segment cup is provided as reception for the cylindrical surface of the adjusting nut, and that the blocking slide contacts the cylindrical surface of the adjusting nut in the emergent position.

2. A pivotal hinge for an arm of an awning according to claim 1, characterized in that, within the supporting block, a bolt with a transverse passage and with a reception for a ball end of the coupling rod is provided.

3. A pivotal hinge for an arm of an awning according to claim 2, characterized in that an adjusting means is provided in the foot of the coupling rod.

4. A pivotal hinge for an arm of an awning according to claim 1, characterized in that the adjusting nut comprises a transverse hole for a locking screw.

5. A pivotal hinge for an arm of an awning according to claim 1, characterized in that on the pivotal bracket a support leg is provided for the supporting of the adjusting nut.

6. A pivotal hinge for an arm of an awning according to claim 1, characterized in that the arm comprises a connecting link guide for a coupling pin of the blocking slide.

7. A pivotal hinge for an arm of an awning according to claim 6, characterized in that the connecting link guide has a keyhole-shaped profile.

* * * * *